US010561174B2

(12) United States Patent
Prestia et al.

(10) Patent No.: US 10,561,174 B2
(45) Date of Patent: Feb. 18, 2020

(54) METHOD FOR MANUFACTURING INDUCTIVELY HEATABLE TOBACCO PRODUCTS

(71) Applicant: PHILIP MORRIS PRODUCTS S.A., Neuchatel (CH)

(72) Inventors: Ivan Prestia, Longara di Calderara di Reno (IT); Daniele Sanna, Marin-Epagnier (CH); Christian Agostini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 122 days.

(21) Appl. No.: 15/569,220

(22) PCT Filed: May 19, 2016

(86) PCT No.: PCT/EP2016/061172
§ 371 (c)(1),
(2) Date: Oct. 25, 2017

(87) PCT Pub. No.: WO2016/184930
PCT Pub. Date: Nov. 24, 2016

(65) Prior Publication Data

US 2018/0352855 A1 Dec. 13, 2018

(30) Foreign Application Priority Data

May 21, 2015 (EP) ..... 15168557

(51) Int. Cl.
*A24C 5/40* (2006.01)
*A24F 47/00* (2020.01)
*A24D 1/00* (2020.01)

(52) U.S. Cl.
CPC ..... *A24F 47/008* (2013.01); *A24C 5/40* (2013.01); *A24D 1/002* (2013.01)

(58) Field of Classification Search
CPC combination set(s) only.
See application file for complete search history.

(56) References Cited

U.S. PATENT DOCUMENTS 190,541 A * 5/1877 Bromwell ..... A24C 5/42 131/70
3,840,028 A 10/1974 Yatrides
(Continued)

FOREIGN PATENT DOCUMENTS

CN 102970885 3/2013
DE 102007023776 12/2008
(Continued)

OTHER PUBLICATIONS

PCT/EP2016/061172 International Search Report and Written Opinion dated Aug. 16, 2016 (10 pages).
(Continued)

*Primary Examiner* — Eric Yaary
(74) *Attorney, Agent, or Firm* — Mueting, Raasch & Gebhardt, P.A.

(57) ABSTRACT

The method for manufacturing inductively heatable tobacco products comprises the steps of providing a tobacco product, providing a susceptor segment and positioning the susceptor segment in the tobacco product by moving the susceptor segment and the tobacco product relative to each other. Thereby the susceptor segment is pushed into the tobacco product.

12 Claims, 3 Drawing Sheets

(56) References Cited

U.S. PATENT DOCUMENTS

| | | | | |
|---|---|---|---|---|
| 4,570,645 | A * | 2/1986 | Newman, Sr. | A24F 13/14 131/175 |
| 2015/0272219 | A1 * | 10/2015 | Hatrick | A24F 47/008 131/328 |

FOREIGN PATENT DOCUMENTS

| | | | | |
|---|---|---|---|---|
| GB | 2469850 | | 11/2010 | |
| WO | WO 2011/137453 | | 11/2011 | |
| WO | WO-2013098405 | A2 * | 7/2013 | A24F 47/004 |
| WO | WO 2014/048745 | | 4/2014 | |

OTHER PUBLICATIONS

PCT/EP2016/061172 International Preliminary Examination Report dated Apr. 10, 2017 (14 pages).

* cited by examiner

METHOD FOR MANUFACTURING INDUCTIVELY HEATABLE TOBACCO PRODUCTS

This application is a U.S. National Stage Application of International Application No. PCT/EP2016/061172, filed May 19, 2016, which was published in English on Nov. 24, 2016, as International Publication No. WO 2016/184930 A1. International Application No. PCT/EP2016/061172 claims priority to European Application No. 15168557.5 filed May 21, 2015.

The present invention relates to a method and apparatus for manufacturing inductively heatable tobacco products for use in inductive heating devices.

From the prior art electronic heating devices are known that may resistively heat an aerosol-forming substrate. Before use, a smoking article is inserted into a cavity of the heating device and by this the aerosol-forming substrate is pushed over a heatable blade of the heating device. Such smoking articles are not or only in a limited manner suitable to be used in inductive heating devices. Therein, an induction source produces an alternating electromagnetic field, which induces heat generating eddy currents and hysteresis losses in a susceptor. The susceptor must be at least in thermal proximity of the aerosol-forming substrate, for example a tobacco substrate. The heated susceptor in turn heats the aerosol-forming substrate, which comprises a material, which is capable of releasing volatile compounds that can form an aerosol.

It would be desirable to have an apparatus and method for manufacturing inductively heatable tobacco products, wherein aerosol-forming tobacco products as known from resistive heating devices may be used.

According to an aspect of the present invention, there is provided an apparatus for manufacturing inductively heatable tobacco products. The apparatus comprises a first receiving portion comprising at least one flute for accommodating at least one tobacco product. The apparatus further comprises a second receiving portion comprising at least one receiving section for accommodating at least one susceptor segment. The receiving section may, for example, be a receiving surface for accommodating the at least one susceptor segment on the surface. The first receiving portion and the second receiving portion are arranged such that a longitudinal axis of the at least one flute of the first receiving portion is aligned with the at least one receiving section of the second receiving portion. Preferably, the longitudinal axis of the at least one flute of the first receiving portion is aligned with a longitudinal axis of the at least one receiving section of the second receiving portion. The first receiving portion and the second receiving portion are also arranged such that the first receiving portion and the second receiving portion are movable relative to and against each other, for example mounted on a movable support, such that the at least one susceptor segment in the second receiving portion is pushed into and positioned in the at least one tobacco product in the first receiving portion upon moving the first and second receiving portion against each other.

Preferably, this is done by a relative linear movement of the first receiving portion and the second receiving portion in a direction along the longitudinal axis of the at least one flute or in a direction parallel to said longitudinal axis of the at least one flute. Thereby, preferably, flute and receiving section remain stationary, while parts of the receiving portions are moved more relative to each other. Thereby, preferably, either the tobacco product is moved into the direction of the susceptor segment of the susceptor segment is moved into the direction of the tobacco product. Such parts of the receiving portions may, for example, be pushing elements for pushing the tobacco products out of the flute or for pushing the susceptor segments out of the receiving section or for pushing both tobacco product and susceptor segments versus each other.

The apparatus according to the invention allows to manufacture inductively heatable tobacco products to be used in combination with inductive heating devices from tobacco products used in resistive heating devices. This may be achieved by inserting susceptor segments, for example stainless steel strips, directly into a tobacco segment, for example of a final tobacco product. Thus, it is possible to manufacture tobacco products according to an actual production process known from the production of tobacco products used for resistive heating devices. These tobacco products are after manufacturing are, for example, directly transported to a packer machine. The apparatus according to the invention may be added to the manufacturing line, for example, after such a manufacturing process, and before the so produced inductively heatable tobacco products are further transported to, for example, a preferably same packer machine.

The term 'tobacco product' as used in this application may refer to an aerosol-forming tobacco segment or tobacco plug, respectively, which is in the apparatus and with the method as described herein provided with a susceptor segment to form an inductively heatable tobacco product or inductively heatable tobacco segment, respectively. The 'tobacco product' may also be a tobacco segment attached to a mouthpiece, which optionally may comprise a filter plug and which tobacco product may comprise further segment, for example aerosol-cooling or spacer segments. The filter plug and further segments may be selected in accordance with the composition of the tobacco plug. The aerosol-forming tobacco plug and the mouthpiece and possibly the additional segments may be assembled to form a structural entity. The tobacco product may, for example, be a final product, that is, a ready to be used consumable, such as for example, an aerosol-generating smoking article, to be used in combination with an electronic heating device, such as an e-cigarette. With the method and in the apparatus according to the invention, such tobacco products are provided with a susceptor segment and are made suitable for inductive heating without having to change the known manufacturing processes of conventional tobacco products for electronic heating devices.

Preferably, the tobacco product has a longitudinal extension and has a circular or oval cross-section. However, the tobacco product may also have the cross-section of a rectangle or of a polygon. Preferably, the tobacco product is rod-shaped. The tobacco product is or comprises a tobacco segment made of an aerosol-forming tobacco substrate. Preferably, the aerosol-forming tobacco substrate contains volatile tobacco flavour compounds, which are released from the tobacco substrate upon heating. The aerosol-forming tobacco substrate may comprise or consist of blended tobacco cut filler or may comprise homogenised tobacco material. Homogenised tobacco material may be formed by agglomerating particulate tobacco. The aerosol-forming substrate may additionally comprise a non-tobacco-containing material, for example homogenised plant-based material other than tobacco.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

A crimped tobacco sheet, for example a cast leaf, may have a thickness in a range of between about 0.5 millimeter and about 2 millimeter, preferably between about 0.8 millimeter and about 1.5 millimeter, for example 1 millimeter. Deviations in thickness of up to about 30 percent may occur due to manufacturing tolerances. The crimped tobacco sheet may be gathered to form a rod-shaped tobacco segment.

As used herein, the term 'susceptor' refers to a material that is capable to convert electromagnetic energy into heat. When located in an alternating electromagnetic field, eddy currents are induced and hysteresis losses occur in the susceptor segment causing heating of the susceptor segment. As the susceptor segment is located in thermal contact or close thermal proximity with the aerosol-forming tobacco substrate, the aerosol-forming tobacco substrate is heated by the susceptor segment such that an aerosol is formed. Preferably, the susceptor segment is arranged in direct physical contact with the aerosol-forming tobacco substrate, for example within the aerosol-forming tobacco substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500° C. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and the temperature control of the heating may be separated. The first susceptor material is preferably a magnetic material having a Curie temperature that is above 500° C. It is desirable from the point of view of heating efficiency that the Curie temperature of the first susceptor material is above any maximum temperature that the susceptor should be capable of being heated to. The second Curie temperature may preferably be selected to be lower than 400° C., preferably lower than 380° C., or lower than 360° C. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate. The second Curie temperature may, for example, be within the range of 200° C. to 400° C., or between 250° C. and 360° C. The second Curie temperature of the second susceptor material may, for example, be selected such that, upon being heated by a susceptor that is at a temperature equal to the second Curie temperature, an overall average temperature of the aerosol-forming substrate does not exceed 240° C. The first receiving portion and the second receiving portion are designed and adapted to receive and accommodate the at least one tobacco product and the at least one susceptor segment, respectively. Preferably, the tobacco segments and the susceptor segments are secured in the respective receiving portions such that no unintentional displacement of the tobacco product in the flute or out of the flute or of the susceptor segment in the receiving section or out of the receiving section is possible.

According to an aspect of the apparatus according to the invention, the apparatus further comprises a retaining element for retaining the at least one tobacco product in the at least one flute of the first receiving portion. A retaining element may secure the position of the tobacco product in the flute, preferably also during positioning of the susceptor segment in the tobacco product, that is, while a pushing force acts onto the tobacco product during the positioning step. A retaining element may, for example, be a simple stopper arranged at a distal end of a flute (arranged remote from the second receiving portion), such that a longitudinal movement of the tobacco product in the flute is limited by the stopper. The retaining element may comprise at least one flute for clamping the at least one tobacco product between the at least one flute of the first receiving portion and the at least one flute of the retaining element. In a flute, the tobacco product may be clamped along its entire length. A tobacco product clamped between two flutes may also not bend or fall out of the flute of the first retaining portion when a pushing force acts on an end and along the longitudinal axis of the tobacco product.

A retaining element may also be provided to secure the position of the susceptor in a receiving portion. Such a retaining element may be a simple stopper arranged at a proximal end of a receiving section (arranged remote from the first receiving portion), such that a longitudinal movement of the susceptor in the receiving portion in a direction opposite the direction versus the tobacco product is limited by the stopper.

According to another aspect of the apparatus according to the invention, the apparatus further comprises an actuation element for actuating a movement mechanism for relatively moving the first receiving portion and the second receiving portion against or away from each other. The first and second receiving portion may be moved manually or automatically against each other for susceptor insertion or away from each other after susceptor insertion and for preparing the apparatus for performing the manufacturing method. An insertion process step may be supported by an actuation element, for example a handle or in case of automatic operation, a start button activating the handle or the otherwise constructed movement mechanism. By operation of the actuation element and actuation of the movement mechanism accordingly, either the first or the second receiving portion or both, the first and the second receiving portion are moved in a direction against or away from each other. To achieve this, the first or the second receiving portion or both are movably mounted in the apparatus. Preferably, either one of the first and the second receiving portions or parts thereof are movably mounted.

Preferably, the first receiving portion comprises a plurality of flutes for accommodating a plurality of tobacco products and the second receiving portion comprises a plurality of receiving sections for accommodating a plurality of susceptor segments. Preferably, the plurality of the receiving sections of the second receiving portion corresponds to the plurality of flutes of the first receiving portion. The plurality of receiving sections may, for example, be a plurality of flat receiving surfaces for receiving susceptor blades or strips. Preferably, the plurality of tobacco products supplied to the apparatus corresponds to the plurality of susceptor segments supplied to the apparatus. Upon the provision of a plurality of flutes and a plurality of receiving sections, a plurality of tobacco products may be provided with a susceptor segment each, preferably simultaneously. By this, production of inductively heatable tobacco products may be enhanced. In addition, if a same plurality of tobacco products and susceptor segments are provided, all tobacco products loaded into an apparatus will be transformed into inductively heatable tobacco products during an insertion step.

If the first receiving portion comprises a plurality of flutes, the first receiving portion may comprise 2 to 200 flutes, preferably 10 to 100 flutes, more preferably 20 to 60 flutes for accommodating the tobacco products. Accordingly, a plurality of receiving sections in the second receiving portion may be 2 to 200, preferably 10 to 100, more preferably 20 to 60 for accommodating the susceptor segments.

A loading of the apparatus with tobacco products and susceptor segments may be provided manually or automatically. An automatic loading may, for example, be realized by a feeding mechanism, for example feeding wheels. One feeding mechanism may be provided for each flute and for each receiving section. It is also possible to provide one feeding mechanism for a plurality of flutes and another feeding mechanism for a plurality of susceptor segments. Also the insertion step may be performed automatically, for example, by an automatic starting of the manufacturing process as soon as a loading of the apparatus with tobacco products and susceptor segments has been completed. A corresponding electronic control of the insertion process or possibly also of one or several feeding mechanism may be provided.

In a fully automated process, a continuous manufacture of inductively heatable tobacco products may be achieved. Such continuous manufacture may be batch wise, for example, if a plurality of inductively heatable tobacco product is manufactured simultaneously. If the manufacture of inductively heatable tobacco products is performed sequentially, constant continuous manufacturing may be achieved.

According to another aspect of the present invention, there is provided a method for manufacturing inductively heatable tobacco products in an apparatus according to the invention and as described herein. The method comprises the steps of providing a tobacco product, providing a susceptor segment and positioning the susceptor segment in the tobacco product by moving the susceptor segment and the tobacco product relative to each other. Thereby the susceptor segment is pushed into the tobacco product, preferably entirely into a tobacco segment of the tobacco product.

Advantages of the method have been described relating to the apparatus according to the invention and will not be repeated.

The tobacco product may comprise a tobacco segment containing tobacco substrate and further segments, such as, for example, filter segments or a mouth piece. In such tobacco products, the susceptor segment is positioned in the tobacco segment of the tobacco product, preferably, in the tobacco segment only.

Preferably, a length of the susceptor segment is smaller or equal to the length of a tobacco product, preferably smaller than the length of a tobacco segment. Preferably, the susceptor segment has at a maximum a same length as a longitudinal extension of the tobacco substrate in the tobacco product. By this, the susceptor segment may entirely be enveloped by tobacco substrate.

A tobacco segment (or tobacco product if no further segments or elements are provided) may have a segment length in a range between about 2 millimeter and about 20 millimeter, more preferably between about 6 millimeter and about 15 millimeter, for example between about 8 millimeter and about 12 millimeter such as 10 millimeter or 12 millimeter.

The susceptor segment preferably has a length of between about 2 millimeter and about 20 millimeter, more preferably between about 6 millimeter to about 15 millimeter, for example between about 8 millimeter and about 12 millimeter such as 10 millimeter or 12 millimeter.

Whenever the term 'about' is used in connection with a particular value throughout this application this is to be understood such that the value following the term 'about' does not have to be exactly the particular value due to technical considerations. However, the term 'about' is understood as explicitly including and disclosing the respective boundary value.

Preferably, the susceptor segment has a length dimension that is greater than its width dimension or its thickness dimension, for example greater than twice its width dimension or its thickness dimension.

The susceptor segment may be a filament, rod, sheet or band. If the susceptor segment has a constant cross-section, for example a circular cross-section, it has a preferable width or diameter of between about 1 millimeter and about 5 millimeter. If the susceptor segment has the form of a sheet or band, the sheet or band preferably has a substantially rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example 0.07 millimeter. Preferably, the susceptor segment has a pointed first end and a flat second end. The susceptor segment is then arranged in the receiving section such that the pointed first end directs versus the tobacco product. The pointed first end supports an introduction of the susceptor segment into the tobacco product.

According to an aspect of the method according to the invention, the step of positioning the susceptor segment in the tobacco product comprises positioning the susceptor segment in a central portion of the tobacco product. Preferably, the susceptor segment is positioned in a central portion of a tobacco substrate. A central positioning may be favorable in view of heat distribution in the tobacco substrate, for example for a homogeneous or symmetric heat distribution in a tobacco product or in a tobacco segment of a tobacco product, respectively. Heat generated in the central portion may dissipate in radial direction and heat-up tobacco substrate around an entire circumference of the susceptor segment.

Preferably, a central portion of the tobacco product is a region of the tobacco product encompassing a central axis of the tobacco product. The susceptor segment is arranged substantially longitudinally within the tobacco product. This means that a length dimension of the susceptor segment is arranged to be approximately parallel to a longitudinal direction of the tobacco product, for example within plus or minus 10 degrees of parallel to the longitudinal direction of the tobacco product. Preferably, the susceptor segment may be positioned in a radially central position within the tobacco product, and extends along the longitudinal axis of the tobacco product.

According to another aspect of the method according to the invention, the method comprises the steps of providing a plurality of tobacco products and providing a plurality of susceptor segments and positioning, preferably simultaneously, each one of the plurality of susceptor segments in a corresponding tobacco product of the plurality of tobacco products. Preferably, the plurality of the susceptor segments corresponds to the plurality of the tobacco products.

The method may further comprise the step of keeping the tobacco product or the plurality of tobacco products stationary, while moving the susceptor segment or the plurality of susceptor segments during positioning of the susceptor segment in the tobacco product or during positioning of the plurality of susceptor segments in the plurality of tobacco products. To position the susceptor segment in the tobacco product, both the tobacco product and the susceptor segment may be moved versus each other. From a constructional and maintenance point of view, it may be favorable to have only few movable parts in an apparatus. By moving the tobacco products only or the susceptor segments only, a corresponding moving mechanism on either the first receiving portion or the second receiving portion is required.

The method may comprise the steps of providing a first receiving portion comprising a flute or a plurality of flutes for accommodating the tobacco product or the plurality of tobacco products and providing a second receiving portion comprising a receiving section or a plurality of receiving sections for accommodating the susceptor segment or the plurality of susceptor segments. A further step comprise aligning a longitudinal axis of the flute or a plurality of longitudinal axes of the plurality of flutes of the first receiving portion with the receiving section or the plurality of receiving sections of the second receiving portion, such that upon relatively moving the first receiving portion and the second receiving portion against each other pushing and positioning the susceptor segment or the plurality of susceptor segments of the second receiving portion into and in the tobacco product or into and in the plurality of tobacco products of the first receiving portion.

The method may further comprise the step of retaining the tobacco product or the plurality of tobacco products in the flute or in the plurality of flutes of the first receiving portion by the provision of a retaining element. The step of retaining may be provided by clamping the tobacco product or the plurality of tobacco products between the flute or the plurality of flutes of the first receiving portion and a flute or a plurality of flutes of the retaining element.

The method may further comprise the step of actuating a movement mechanism for relatively moving the first receiving portion and the second receiving portion against or away from each other.

According to yet another aspect of the invention there is provided an inductively heatable smoking article for use in an inductive heating device. The inductively heatable smoking article comprises or consists of an inductively heatable tobacco product manufactured in the apparatus or with the method according to the invention. The inductively heatable smoking article comprises an inductively heatable tobacco segment. The inductively heatable tobacco segment comprises aerosol-forming tobacco substrate and a susceptor segment. In general, an inductively heatable smoking article is introduced into a cavity of the inductive heating device such that heat may be induced in the susceptor segment of the tobacco segment by a corresponding inductor of a power supply electronics arranged in the inductive heating device.

The invention is further described with regard to embodiments, which are illustrated by means of the following drawings, wherein:

FIG. 1 schematically illustrates an apparatus for insertion of susceptor segments into tobacco products;

Figure 1:
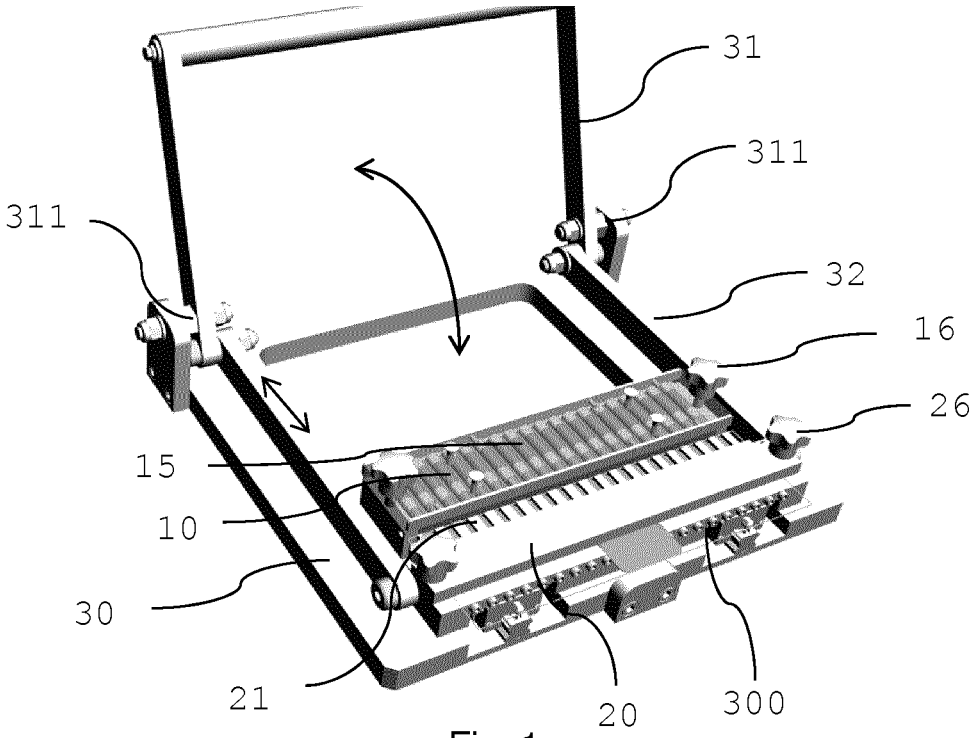
Figure 2:
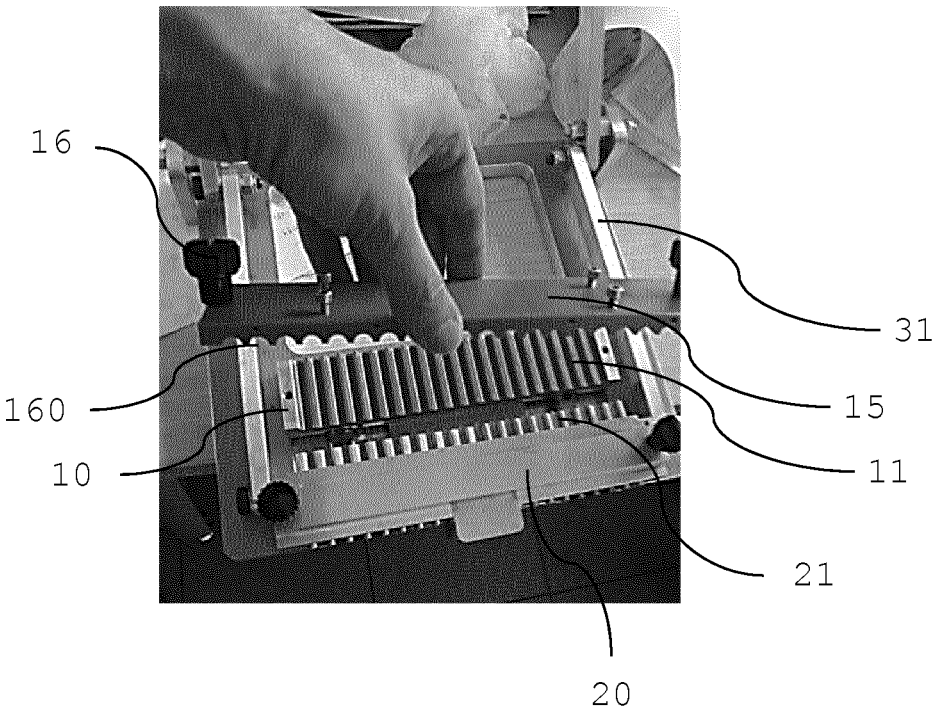
FIG. 2 shows an apparatus with separated retaining element.

In FIG. 1 and FIG. 2 an apparatus for susceptor segment insertion into a tobacco product is shown.

The apparatus comprises a frame 30 with a first receiving portion 10 and a second receiving portion 20 arranged in the frame 30. The first receiving portion 10 is fixedly arranged in the frame 30 at a distance from a front side 300 of the frame 30 and at a distance to the second receiving portion 20. The second receiving portion 20 is movably arranged in the frame 30 and positioned at the front side 300 of the frame 300.

A linear movement of the second receiving portion 20 is achieved by turning a lever 31 (indicated with arrow), which lever 31 is rotatably attached to the frame 20 via shaft 311. Offset to the position of the shaft 311, the lever 31 is rotatably connected to one end of a connection bar 32. The connection bar 32 is arranged parallel to and along a side of the frame 30. The other end of the connection bar 32 is fixed to the second receiving portion 20. Lever 31 and connection bar 32 thus form a moving mechanism for the second receiving portion 20.

In FIGS. 1 and 2, the lever 31 is in a retracted position, which corresponds to a preparation status of the apparatus. Upon operation of the lever 31 (pressing downwards), the second receiving portion 20 is made to move versus the first receiving portion 10. The first receiving portion 10 provides an end stop to the second receiving portion 20.

Figure 3:
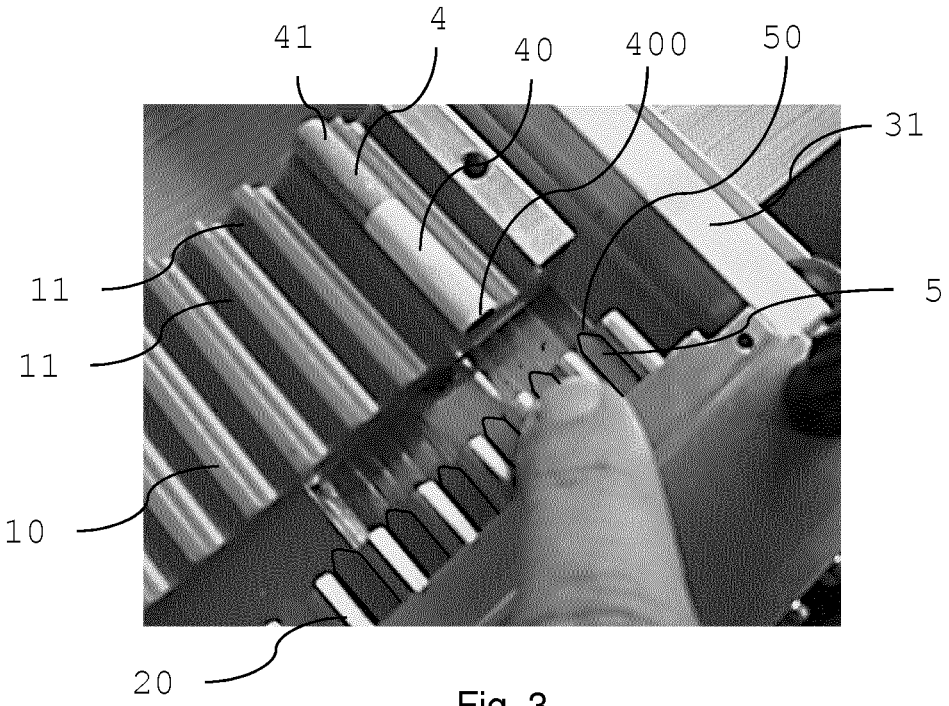
FIG. 3 shows a detail of the apparatus of FIG. 2 with tobacco product and susceptor segments.

First receiving portion 10 is provided with a plurality of flutes 11, for example, a few tens of flutes, for example, 20 flutes, for accommodating a plurality of tobacco products. This is shown in more detail in FIG. 3. The flutes 11 are arranged equidistantly in the first receiving portion 10 and parallel to each other with their longitudinal axis parallel to the moving direction of the second receiving portion 20 (indicated by arrow). The second receiving portion 20 is provided with a plurality of receiving surfaces 21 for accommodating a plurality of susceptor segments 5 in the form of strips. The receiving surfaces 21 are arranged equidistantly in the second receiving portion 20 and parallel to each other with a longitudinally axis aligned with the longitudinal axis of the flutes 11 of the first receiving portion 10. Horizontal, vertical and lateral position of the receiving surfaces 21 and the flutes 11 are adjusted such that upon insertion of the susceptor segments 5 into the tobacco products 4, the susceptor segment 5 is arranged in the tobacco product at a predefined position. Preferably, the predefined position corresponds to a central position of the tobacco product and in a tobacco segment 41 of the tobacco product 4 only. The tobacco product 4 as shown in FIG. 3 is a tobacco product that may directly be used in an electronic heating device with resistively heated heating blade. The tobacco product 4 comprises a filter segment 41 and a tobacco segment 41.

In the flute, a tobacco end 400 of the tobacco product 4 is aligned flush with a front side of the first receiving portion 10. For insertion of the susceptor segment 5 into the tobacco product, a pointed end 50 of the susceptor strip directs to the tobacco end 400 of the tobacco product 4.

The upper portion 26 of the second receiving portion 20 is movable along guide elements 23. By this movement all susceptor segments 5 are simultaneously pushed forward into the tobacco ends 400 of the tobacco products 4.

Figure 4:
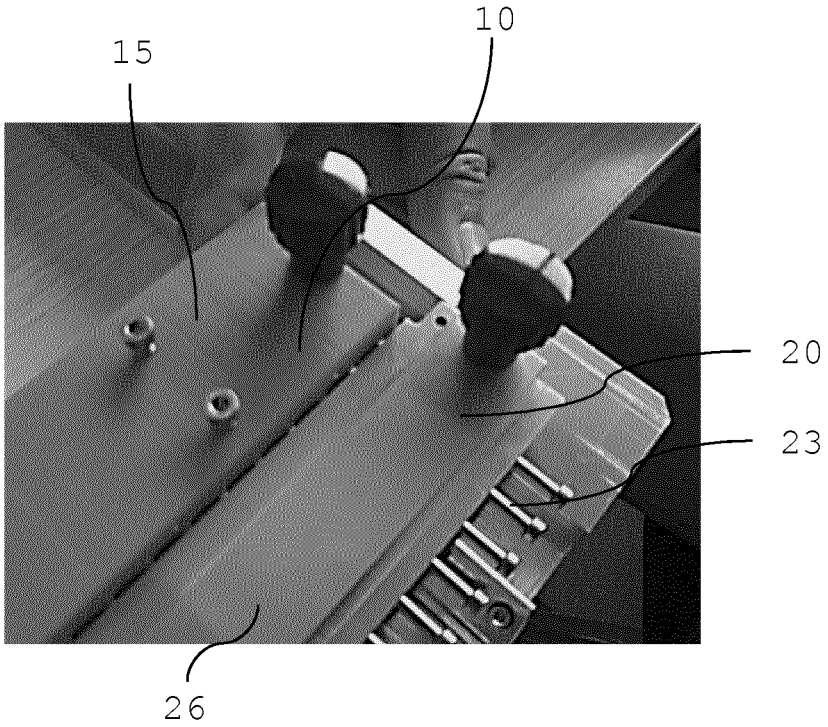
FIG. 4 shows the manufacturing step with entirely inserted susceptor segments.

An insertion position of first and second receiving portions 10,20 is shown in FIG. 4. In the embodiment shown, the insertion position is reached when the second receiving portion 20 abuts the first receiving portion 10. This is at the same time the farthest position the susceptor segments may be moved and inserted into a tobacco product if aligned as in FIG. 3. After insertion, the lever 31 of the apparatus may be operated again in the opposite direction and moved to its retracted position. By this, the second receiving portion 20 is moved back to its initial position at the front side 300 of the frame.

As can best be see in FIG. 2, the first receiving portion 10 is provided with a retaining element 16. The retaining element 16 comprises a plurality of flutes 160, which number, size and arrangement may be identical to the flutes 11 of the first receiving portion 10. The retaining element 16 is removably mountable via screws 16 to the first receiving portion 10, By this, tobacco products 4 provided in the flutes 11 of the first receiving portion 10 are held in between the retaining element 15 and first receiving portion. Via screws 16 a clamping force acting on the tobacco products may be defined.

After susceptor insertion, the retaining element 15 may be removed. The inductively heatable tobacco products may then be removed from the apparatus and, for example, packed for selling.

The apparatus is now ready again for being provided with tobacco products 4 into the flutes 11 and susceptor segments 5 onto the receiving surfaces 21 for renewed manufacture of inductively heatable tobacco products.

Figure 5:
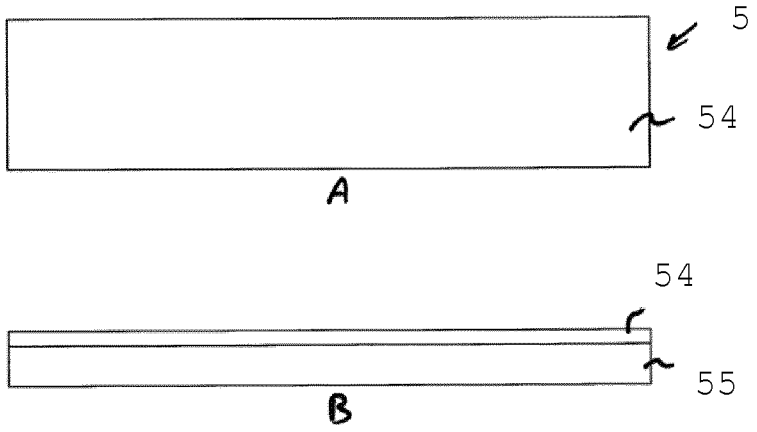
FIG. 5A is a plan view of a susceptor for use in a tobacco product.
FIG. 5B is a side view of the susceptor of FIG. 5A.

FIG. 5A and FIG. 5B illustrate an example of a unitary multi-material susceptor for use in a tobacco product according to an embodiment of the invention. The susceptor 5 is in the form of an elongate strip having a length of 12 mm and a width of 4 mm. The susceptor is formed from a first susceptor material 55 that is intimately coupled to a second susceptor material 54. The first susceptor material 55 is in the form of a strip of grade 430 stainless steel having dimensions of 12 mm by 4 mm by 25 micrometres. The second susceptor material 54 is in the form of a strip of nickel having dimensions of 12 mm by 4 mm by 10 micrometres. The susceptor is formed by cladding the strip of nickel 54 to the strip of stainless steel 55. The total thickness of the susceptor is 35 micrometres. The susceptor 5 of FIG. 2 may be termed a bi-layer or multilayer susceptor.

The set-up of the apparatus may easily be adapted to different forms and types of tobacco products as well as to different forms of susceptor segments. This may, for example be done, by adaption of clamping forces, or a different positioning of first and/or second receiving portion, for example changing a relative distance between first and second receiving portion. Adaption may, for example, also be performed by replacement of one of the first or of the second receiving portion or of both, the first and the second receiving portion. For example, if thinner tobacco products shall be provided with a susceptor segment, the first or the second receiving portion, or both adapted to the new tobacco product and possibly also new susceptor size or form may be replaced.

While the apparatus and method according to the invention has been described with the example of a manual apparatus, operation of the apparatus may also be performed automatically, for example, by means of a motor. Also, a supply of tobacco products and susceptor segments may be performed automatically, for example by an appropriate loading mechanism.

The invention claimed is:

1. Method for manufacturing inductively heatable tobacco products, the method comprising the steps of:

providing a tobacco product, and providing a first receiving portion comprising a flute accommodating the tobacco product in the flute;

providing a susceptor segment, and providing a second receiving portion comprising a receiving section accommodating the susceptor segment in the receiving section;

positioning the susceptor segment in the tobacco product by moving the susceptor segment and the tobacco product relative to each other, thereby pushing the susceptor segment into the tobacco product;

aligning a longitudinal axis of the flute of the first receiving portion with the receiving section of the second receiving portion, such that upon relatively moving the first receiving portion and the second receiving portion against each other pushing and positioning the susceptor segment of the second receiving portion into and in the tobacco product of the first receiving portion.

2. Method according to claim 1, wherein the step of positioning the susceptor segment in the tobacco product comprises positioning the susceptor segment in a central portion of the tobacco product.

3. Method according to claim 1, wherein a length of the susceptor segment is smaller or equal to the length of a tobacco product.

4. Method according to claim 1, wherein the tobacco product comprises a tobacco segment and the susceptor segment is positioned in the tobacco segment of the tobacco product.

5. Method according to claim 1, wherein the susceptor segment has a pointed first end and a flat second end and arranging the susceptor segment in the receiving section such that the pointed first end directs versus the tobacco product.

6. Method according to claim 1, providing a plurality of tobacco products and providing a plurality of susceptor segments and positioning, each one of the plurality of susceptor segments in a corresponding tobacco product of the plurality of tobacco products.

7. Method according to claim 1, further comprising the step of keeping the tobacco product or a plurality of tobacco products stationary, while moving the susceptor segment or a plurality of susceptor segments during positioning of the susceptor segment in the tobacco product or during positioning of the plurality of susceptor segments in the plurality of tobacco products.

8. Method according to a claim 1, comprising the steps of:

providing the first receiving portion comprising a plurality of flutes for accommodating a plurality of tobacco products;

providing the second receiving portion comprising a plurality of receiving sections for accommodating a plurality of susceptor segments;

aligning a plurality of longitudinal axes of the plurality of flutes of the first receiving portion with the plurality of receiving sections of the second receiving portion, such that upon relatively moving the first receiving portion and the second receiving portion against each other pushing and positioning the plurality of susceptor segments of the second receiving portion into and in the plurality of tobacco products of the first receiving portion.

9. Method according to claim 1, further comprising the step of retaining the tobacco product or a plurality of tobacco products in the flute or in a plurality of flutes of the first receiving portion by the provision of a retaining element.

10. Method according to claim 9, wherein the step of retaining the tobacco product or the plurality of tobacco products in the flute or in a plurality of flutes of the first receiving portion comprises clamping the tobacco product or the plurality of tobacco products between the flute or the plurality of flutes of the first receiving portion and a flute or a plurality of flutes of the retaining element.

11. Method according to claim 1, further comprising the step of actuating a movement mechanism for relatively moving the first receiving portion and the second receiving portion against or away from each other.

12. Method according to claim 1, providing in the first receiving portion 2 to 200 flutes, for accommodating the tobacco products.

* * * * *